United States Patent [19]

Crabb

[11] 4,071,129

[45] Jan. 31, 1978

[54] DOOR HOLD-BACK APPARATUS

[75] Inventor: Elmer Ray Crabb, Pekin, Ill.

[73] Assignee: Caterpillar Tractor Co., Peoria, Ill.

[21] Appl. No.: 715,947

[22] Filed: Aug. 19, 1976

[51] Int. Cl.[2] ..... E05C 3/04

[52] U.S. Cl. ..... 292/246

[58] Field of Search ..... 292/246, 130, 136, DIG. 8

[56] References Cited

U.S. PATENT DOCUMENTS

| | | | |
|---|---|---|---|
| 1,431,040 | 10/1922 | Rawlings | 292/DIG. 19 |
| 1,764,487 | 6/1930 | Young | 292/DIG. 8 |

FOREIGN PATENT DOCUMENTS

| | | | |
|---|---|---|---|
| 545,393 | 3/1932 | Germany | 292/246 |

*Primary Examiner*—Richard E. Moore

*Attorney, Agent, or Firm*—Phillips, Moore, Weissenberger, Lempio & Majestic

[57] ABSTRACT

A door hold-back apparatus comprises a mounting member attached to the side panel of a vehicle and a hook member pivotally mounted on the mounting member for swinging movements between latched and unlatched positions thereon. A cushion means, preferably in the form of an elastomeric pad, is adjustably mounted on the mounting member to engage an abutment member secured on a door of the vehicle. The hook member is adapted to engage a slot formed in the abutment member to hold the door in an open position on the vehicle. Elastomeric bumpers are mounted on a forward end of the hook member to prevent metallic engagement between the hook member and a side panel of the vehicle.

16 Claims, 4 Drawing Figures

FIG. 1.
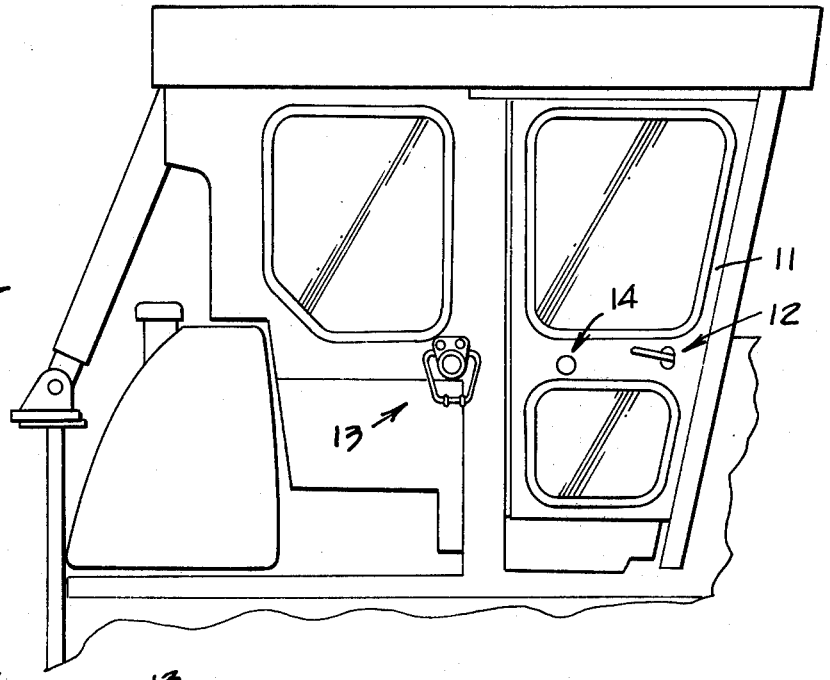
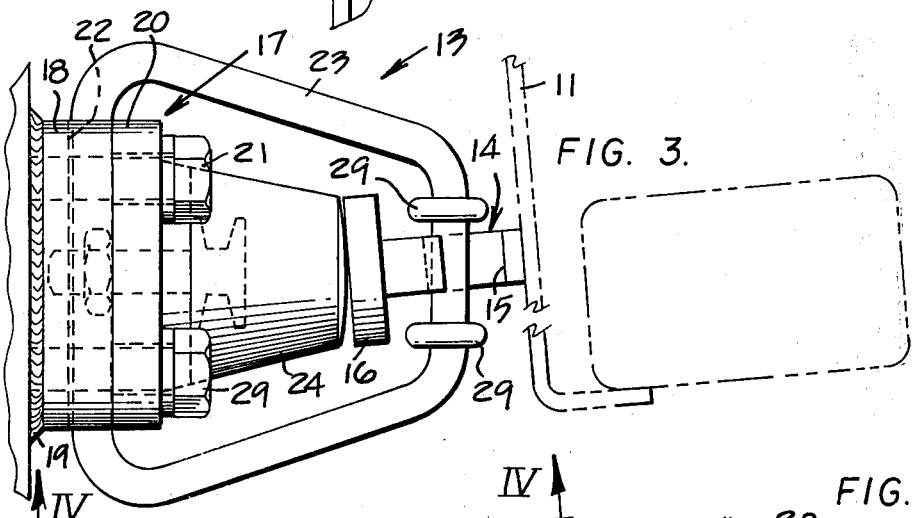
FIG. 3.
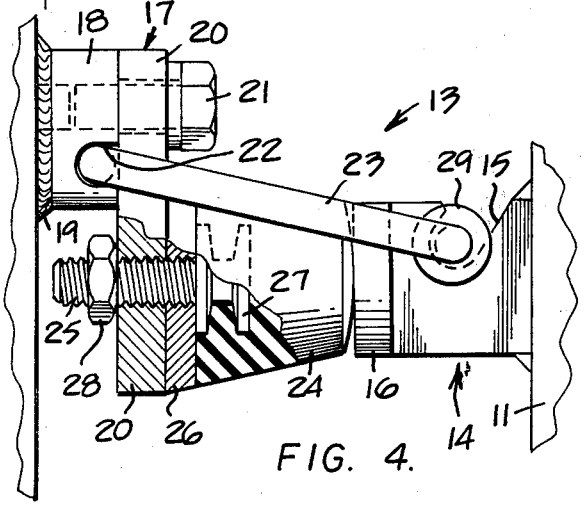
FIG. 4.
FIG. 2.
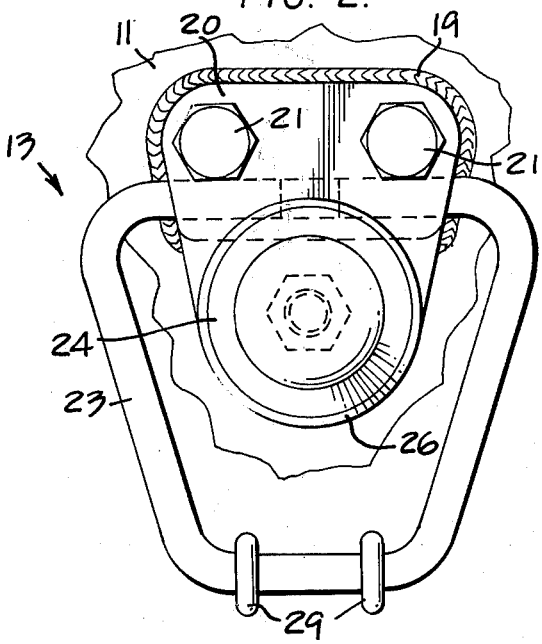

DOOR HOLD-BACK APPARATUS

BACKGROUND OF THE INVENTION

The operator's cab mounted on a construction vehicle normally has at least one access door hingedly mounted thereon. It is desirable to latch the door in an open position during certain operational modes of the vehicle. It is therefore necessary to provide a releasable latching mechanism for selectively holding the door in such open position. Conventional latching mechanisms do not always assure firm holding of the door in its open position and do not provide adjustment thereof to compensate for manufacturing tolerances and wear.

SUMMARY OF THIS INVENTION

An object of this invention is to provide an improved door hold-back apparatus adapted to be mounted on a side panel of a vehicle to selectively hold a door thereof in an open position. The apparatus comprises a mounting member having a hook member pivotally mounted thereon for swinging movements between latched and unlatched positions thereon. A cushioning means is attached to the mounting member and disposed adjacent to the hook member for aiding the hook member in latching the door thereto and to absorb vibratory energy.

BRIEF DESCRIPTION OF THE DRAWING

Other objects of this invention will become apparent from the following description and accompanying drawing wherein:

FIG. 1 is a side elevational view of an operator's cab having the door hold-back apparatus of this invention mounted thereon;

FIG. 2 is an enlarged view of the door hold-back apparatus;

FIG. 3 is a top plan view of the door hold-back apparatus, showing it in a latched position; and FIG. 4 is a side elevational view of the door hold-back apparatus, taken in the direction of arrows IV—IV in FIG. 3.

DETAILED DESCRIPTION

FIG. 1 illustrates an operator's cab 10 having a door 11 hingedly mounted thereon in a conventional manner to be moved between its illustrated closed position and an open position upon actuation of a door latch mechanism 12. When the door is moved to its open position, a hold-back apparatus 13, mounted on a side panel of the operator's cab, is adapted to engage a bracket or latch member 14 secured to the door to hold it in such open position. The bracket has a slot 15 formed therein and an annular abutment plate 16 secured on an end thereof.

Hold-back apparatus 13 comprises a mounting member 17, including a block 18 secured to the operator's cab by welds 19 or the like. A mounting plate 20 is releasably attached to the block by a pair of laterally spaced bolts 21. An elongated slot 22 is formed through a front side of the block to pivotally mount a hook member 23 therein which is constructed in the form of an isosceles trapezoid. The forward end of the hook member is thus adapted to engage slot 15 to hold door 11 in its open position.

It should be noted in FIG. 4 that the slot extends downwardly and inwardly towards the hold-back apparatus to aid in the door retention function. Abutment plate 16 engages an elastomeric cushioning means or pad 24 adjustably mounted on plate 20 by a threaded member 25. The pad may be composed of any suitable elastomeric material, such as plastic or rubber, having a durometer hardness sufficient to slightly compress when engaged by the abutment plate to firmly hold hook member 23 in position.

Pad 24 may be vulcanized or otherwise suitably secured to a circular back-up plate 26, normally disposed in abutting relationship with respect to mounting plate 20. One end of threaded member 25 may have an enlarged head portion 27 formed integrally therewith and imbedded in elastomeric pad 24 to prevent relative movement therebetween. Alternatively, head portion 27 could be eliminated and the first end of member 25 welded directly to plate 26.

The member is threadably mounted in plates 20 and 26 and has at least one jam nut 28 threadably mounted on a second end thereof. The nut functions to lock pad 24 and plate 26 in a desired axial position relative to mounting plate 20. It should be noted that the member 25 need not be threaded to plate 26, if so desired.

The pad is generally frustoconically shaped so that it may be rotated to selectively adjust the pad axially relative to mounting plate 20 to assure that hook member 23 properly engages slot 15 for retaining door 11 in an open position. If so desired, suitable shims (not shown), such as thin washers, could be mounted on the shank of threaded member 25 and disposed between plates 20 and 26 when such adjustment is made. Also, nut 28 could be threadably mounted on member 25, between plates 20 and 26, to provide for outward adjustment of pad 24.

When the door is closed, it should be noted in FIG. 1 that the hock member will pivot automatically downwardly to move it away from any obstructing position adjacent to the door. Bumper means, preferably in the form of a pair of axially spaced annular elastomeric bumpers 29, are mounted on the forward and free end of the hook member to prevent metallic contact between the cab and tht hook member.

What is claimed is:

1. A door hold-back apparatus comprising a mounting means adapted for attachment to a panel of a vehicle comprising a block member adapted for securance to a panel of a vehicle, a plate mounted on an outboard side of said block member and fastening means releasably attaching said plate to said block member, hook means pivotally mounted on said mounting means for swinging movements between latched and unlatched positions thereon, and means defining an elongated slot between said block member and said mounting plate, said hook means disposed in and pivotally mounted in said slot, and cushioning means attached to said mounting means and disposed adjacent to said hook means adapted to aid said hook means in latching a door thereto comprising an elastomeric pad adjustably mounted on said mounting means for axial movement relative thereto.

2. The door hold-back apparatus of claim 1 wherein said slot is formed solely in said block member.

3. The door hold-back apparatus of claim 1 wherein said cushioning means is mounted on said mounting plate.

4. The door hold-back apparatus of claim 3 wherein said cushioning means is threadably mounted for axial adjustment on said mounting plate.

5. The door hold-back apparatus of claim 4 wherein said cushioning means is threadably mounted on said mounting plate by a threaded member having a first end thereof secured to said cushioning means and having at least one nut threadably mounted on a second end thereof.

6. The door hold-back apparatus of claim 1 wherein said hook means is generally constructed in the form of an isosceles trapezoid.

7. The door hold-back apparatus of claim 1 wherein said pad is generally frustoconically shaped.

8. The door hold-back apparatus of claim 7 wherein said pad is secured to a back-up plate and wherein said mounting means comprises a mounting plate having said pad and back-up plate adjustably mounted thereon.

9. The door hold-back apparatus of claim 1 further comprising an operator's cab having said door hold-back apparatus secured thereon, said operator's cab comprising a door hingedly mounted thereon and adapted to be moved between closed and open positions and to be held in said open position by said apparatus.

10. The door hold-back apparatus of claim 9 wherein said door has a latch member secured thereon and means defining a slot in said latch member adapted to engage said hook means to hold said door in the open position thereof.

11. The door hold-back apparatus of claim 10 wherein said slot is formed in said latch member to extend downwardly and rearwardly towards said apparatus when in its open position to aid in said latching said door thereat.

12. The door hold-back apparatus of claim 10 wherein said latch member has an abutment member secured on an end thereof and adapted to engage said cushioning means.

13. The door hold-back apparatus of claim 1 further comprising elastomeric bumper means mounted on a free end of said hook means for preventing metallic contact with a panel of a vehicle when said apparatus is mounted thereon.

14. The door hold-back apparatus of claim 13 wherein said bumper means comprises a pair of axially spaced annular elastomeric bumpers mounted on said hook means.

15. A door hold-back apparatus comprising a mounting means adapted for attachment to a panel of a vehicle, hook means pivotally mounted on said mounting means for swinging movements between latched and unlatched positions thereon, cushioning means attached to said mounting means and disposed adjacent to said hook means adapted to aid said hook means in latching a door thereto and elastomeric bumper means mounted on a free end of said hook means for preventing metallic contact with a panel of a vehicle when said apparatus is mounted thereon.

16. A door hold-back apparatus comprising a mounting means adapted for attachment to a panel of a vehicle, hook means pivotally mounted on said mounting means for swinging movements between latched and unlatched positions thereon, and cushioning means attached to said mounting means and disposed adjacent to said hook means adapted to aid said hook means in latching a door thereto comprising an elastomeric pad adjustably mounted on said mounting means for axial movement relative thereto, said pad being secured to a back-up plate and wherein said mounting means comprises a mounting plate having said pad and said back-up plate adjustably mounted thereon.

* * * * *